United States Patent [19]

Billingsley

[11] 4,375,795

[45] Mar. 8, 1983

[54] DUAL FUEL SUPPLY SYSTEM

[75] Inventor: Henry C. Billingsley, Waukegan, Ill.

[73] Assignee: Outboard Marine Corporation, Waukegan, Ill.

[21] Appl. No.: 175,348

[22] Filed: Aug. 4, 1980

[51] Int. Cl.[3] ..... F02M 1/16

[52] U.S. Cl. ..... 123/187.5 R; 261/DIG. 8

[58] Field of Search ..... 125/575, 576, 577, 187.5 R, 125/179 G; 261/DIG. 8

[56] References Cited

U.S. PATENT DOCUMENTS

| | | | |
|---|---|---|---|
| 2,616,404 | 11/1952 | Bartholomew | 123/575 |
| 2,643,647 | 6/1953 | Meyer et al. | 123/575 |
| 2,664,871 | 1/1954 | Anderson | 123/577 |
| 3,620,202 | 11/1971 | Ross | 123/187.5 R |
| 3,948,589 | 4/1976 | DuBois | 123/187.5 R |
| 4,056,087 | 11/1977 | Boyce | 123/575 |
| 4,085,720 | 4/1978 | Etoh | 123/575 |
| 4,090,484 | 5/1978 | Itoh et al. | 123/575 |
| 4,129,620 | 12/1978 | Etoh | 123/575 |
| 4,203,405 | 5/1980 | Schultz et al. | 123/187.5 R |

FOREIGN PATENT DOCUMENTS 644721 10/1950 United Kingdom .

*Primary Examiner*—Charles J. Myhre
*Assistant Examiner*—E. Rollins Cross
*Attorney, Agent, or Firm*—Michael, Best & Friedrich

[57] ABSTRACT

Disclosed herein is a fuel feeding device comprising a housing including a float chamber including float controlled valve communicable with a source of fuel and operable to control supply of the fuel to said float chamber, a second chamber, a duct extending between said second chamber and said float chamber for supplying fuel to said second chamber from said float chamber, a movable wall located in said second chamber and defining a primer fuel chamber which can be varied in volume and which communicates with said duct, a handle connected to said movable wall for displacing said movable wall to vary the volume of said primer fuel chamber so as to affect fuel flow to and from said primer fuel chamber, a check valve in said duct permitting fuel flow from said float chamber to said primer fuel chamber and preventing return flow to said float chamber, and an outlet communicating with said duct between said primer fuel chamber and said check valve.

3 Claims, 1 Drawing Figure

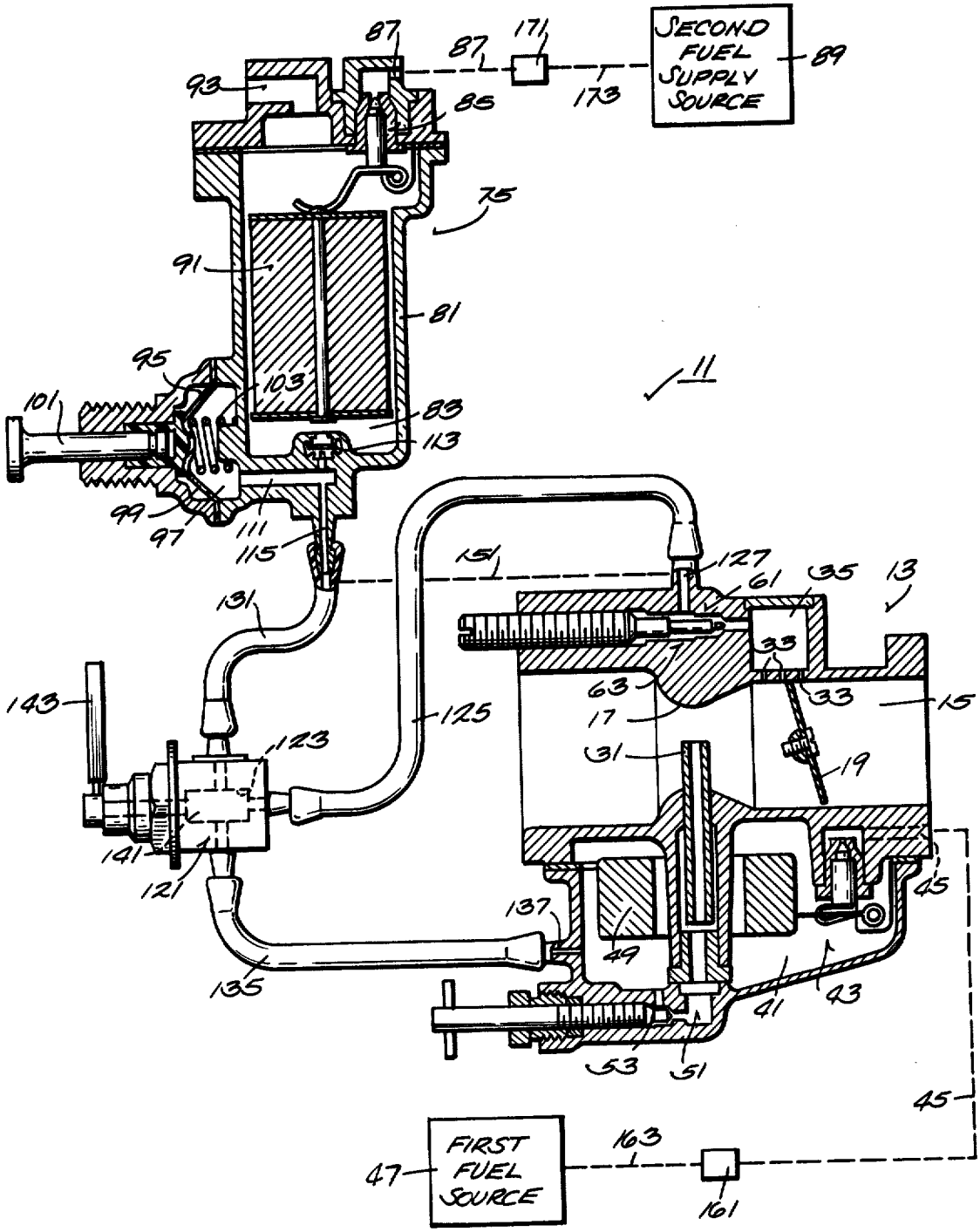
SECOND FUEL SUPPLY SOURCE
FIRST FUEL SOURCE
87
87
171
173
89
93
85
75
91
81
95
103
101
83
113
11
99
97
111
115
151
127
61
35
13
131
33
63
33
15
143
125
17
123
31
19
141
121
45
137
49
135
41
43
53
51
45
47
163
161

DUAL FUEL SUPPLY SYSTEM

BACKGROUND OF THE INVENTION

The invention relates generally to fuel supply systems for internal combustion engines. More particularly, the invention relates to so-called dual fuel supply systems, i.e., systems for selectively supplying two different fuels to an internal combustion engine.

Attention is directed to the fuel supply systems disclosed in the following U.S. Pat. Nos.:

Bartholomew, 2,616,404, issued Nov. 4, 1952
Meyer, 2,643,647, issued June 30, 1953
Boyce, 4,056,087, issued Nov. 1, 1977
Etoh, 4,085,720, issued Apr. 25, 1978
Itoh, 4,090,484, issued May 23, 1978
Etoh, 4,129,620, Dec. 12, 1978.

SUMMARY OF THE INVENTION

The invention provides a fuel supply system comprising a carburetor including means defining an air/fuel induction passage including a main supply jet and a secondary orifice, first fuel supply means including an auxiliary outlet, communicating with the main jet, communicable with a source of a first fuel, and operable to supply the first fuel to the main jet and to the auxilliary outlet, second fuel supply means including an outlet, communicable with a source of a second fuel, and operable to supply the second fuel, and a control valve connected to the secondary orifice, to the auxiliary outlet of the first fuel supply means, and to the outlet of the second fuel supply means, and including a valve member movable between a first position communicating the secondary orifice with the outlet and disconnecting the secondary orifice from the auxiliary outlet and a second position communicating the secondary orifice with the auxiliary outlet and disconnecting the secondary orifice from the outlet.

In one embodiment of the invention, the first fuel supply means includes a first float bowl including the auxiliary outlet and communicating with the main jet, and first float controlled valve means communicable with the source of the first fuel and operable to control supply of the first fuel to the first float bowl, and the second fuel supply means includes a second float bowl including the outlet, and second float controlled valve means communicable with the source of the second fuel and operable to control supply of the second fuel to the second float bowl.

In one embodiment of the invention, the fuel supply system further includes a first fuel supply disconnect fitting communicating with the first valve means, and a second fuel supply disconnect fitting communicating with the second valve means, which first and second fuel supply disconnect fittings are of identical construction.

The invention also provides a fuel feeding device comprising a housing including means defining a float chamber, a second chamber, and duct means extending between the second chamber and the float chamber, float means in the float chamber, fuel inlet means communicable with a source of fuel, valve means connected between the fuel inlet means and the float chamber and connected to the float means for operation between opened and closed positions in response to the location of the float means in the float chamber, a movable wall located in the second chamber and defining a primer fuel chamber which can be varied in volume and which communicates with the duct means, means connected to the movable wall for displacing the movable wall to vary the volume of the primer fuel chamber, check valve means in the duct means permitting flow from the float chamber and preventing return flow to the float chamber, and an outlet communicating with the duct means between the primer fuel chamber and the check valve means.

In one embodiment of the invention, the fuel feeding device further includes valve means for closing the outlet.

The invention also provides a fuel supply system comprising a carburetor including means defining an air/fuel induction passage including a main supply jet and a secondary orifice, means for supplying a first fuel to the main jet, and a combined auxiliary float bowl and primer comprising a housing including means defining a float bowl, a cavity, and duct means extending between the cavity and the float bowl, float controlled valve means communicable with a source of a second fuel and operable to control supply of the second fuel to the float bowl, a movable wall located in the cavity and defining a primer fuel chamber which can be varied in volume and which communicates with the duct means, means connected to the movable wall for displacing the movable wall to vary the volume of the primer fuel chamber, check valve means in the duct means permitting flow from the float bowl and preventing return flow to the float bowl, and an outlet communicating with the duct means between the primer fuel chamber and the check valve means, and with the secondary orifice.

Still further, the invention provides a fuel supply system comprising a carburetor including means defiing an air/fuel induction passage including a main supply jet and a secondary orifice, a first float bowl having an auxiliary outlet and communicating with the main jet, first float controlled valve means communicable with a source of a first fuel and operable to control supply of the first fuel to the first float bowl, a combined auxiliary float bowl and primer comprising a housing including means defining a second float bowl, a cavity, and duct means extending between the cavity and the second float bowl, second float controlled valve means communicable with a source of a second fuel and operable to control supply of the second fuel to the second float bowl, a movable wall located in the cavity and defining a primer fuel chamber which can be varied in volume and which communicates with the duct means, means connected to the movable wall for displacing the movable wall to vary the volume of the primer fuel chamber, check valve means in the duct means permitting flow from the second float bowl and preventing return flow to the second float bowl, and an outlet communicating with the duct means between the primer fuel chamber and the check valve means, and a control valve connected to the secondary orifice, to the auxiliary outlet of the first float bowl, and to the outlet of the combined auxiliary float bowl and primer and including a valve member movable between a first position communicating the secondary orifice with the outlet and disconnecting the secondary orifice from the auxiliary outlet and a second position communicating the secondary orifice with the auxiliary outlet and disconnecting the secondary orifice from the outlet.

Other features and advantages of the embodiments of the invention will become known by reference to the following general description, claims, and drawings.

THE DRAWINGS

FIG. 1 is a schematic view of a fuel supply system embodying various of the features of the invention.

Before explaining the embodiments of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be reqarded as limiting.

GENERAL DESCRIPTION

Shown in FIG. 1 is a fuel supply system 11 for an internal combustion engine (not shown) such as is included in an outboard motor. The fuel supply system 11 is arranged to permit engine operation with two fuels, i.e. to use a first fuel, such as kerosene, for high speed operation, and to use a second fuel, such as gasoline, for engine starting and low speed operation, thereby conserving gasolene supply. In addition, the arrangement is such that the second fuel can be used for both starting and operation at all speeds.

The fuel supply system 11 includes a carburetor 13 which conventionally includes means defining a fuel/air induction passage 15 having a centrally located venturi 17. Downstream from the venturi 17, the fuel/air induction passage 15 includes a throttle valve 19 movable between open and closed positions for controlling air and fuel induction and thus engine speed. A choke valve (not shown) can be used upstream of the venturi 17.

Extending into the venturi 17 is a main fuel jet or sleeve or orifice 31. Located adjacent to the periphery of the throttle valve 19 when in the closed position are one or more secondary orifices 33, each of which communicates with a fuel well 35.

The carburetor 13 also includes a primary or first fuel chamber or float bowl 41 and first valve means 43 which communicates with an inlet duct 45 leading to a source 47 of a first fuel, such as kerosene, which is connected to a float 49 in the fuel bowl 41, and which is operable to supply fuel to the float bowl 41 in accordance with the location of the float 49 in the float bowl 41. Any suitable fuel tank arrangement and fuel pump can be employed for supplying kerosene to the inlet duct 45.

Duct means 51 are provided in the carburetor 13 for communicating the float bowl 41 with the main fuel jet 31, which duct means 51 includes needle valve means 53 for adjusting the fuel flow from the float bowl 41 to the main fuel jet 31.

Duct means 61 are also provided in the carburetor 13 for supplying fuel to the fuel well 35, which duct means 61 includes needle valve means 63 for controlling such fuel flow. As thus far disclosed, the construction is believed to be generally conventional.

Also included in the fuel system 11 is a combined auxiliary or secondary fuel chamber or float bowl and primer which includes a housing 81 which can be suitably supported and which defines an auxiliary or secondary fuel chamber or float bowl 83. The housing 81 also includes second valve means 85 which communicates with an inlet duct 87 leading to a source 89 of a second fuel, such as gasolene, which is connected to a float 91 in the secondary fuel chamber or float bowl 83, and which is operable to supply fuel to the secondary float bowl 83 in accordance with the location of the float 91 in the secondary float bowl 83.

The top of the housing 81 includes a vent 83 communicating between the atmosphere and the secondary fuel chamber or float bowl 83.

The housing 81 also includes, adjacent to the bottom of the secondary float chamber or fuel bowl, wall means defining a second chamber or cavity or void 95 including a movable wall which, together with the cavity wall, defines a primer fuel chamber 97. While various movable wall constructions can be employed, in the disclosed construction, the movable wall is provided by a flexible diaphragm 99 suitably supported at the periphery thereof by the housing 81. Connected to the diaphragm 99 is a plunger stem 101 which extends exteriorly of the housing 81 and is biased outwardly by a suitable spring 103 so as to normally locate the movable wall 99 in position maximizing the size of the primer fuel chamber 97.

Communicating between the primer fuel chamber 97 and the bottom of the secondary fuel chamber or float bowl 83 is wall means defining a fuel duct 111 including suitable check valve means 113 permitting fuel flow from the secondary fuel chamber or float bowl 83 and preventing return flow to the secondary fuel chamber or float bowl 83.

Communicating with the fuel duct 111 between the primer fuel chamber 97 and the check valve means 113 is an outlet or outlet duct or port 115.

The fuel system 13 further includes a selector valve 121 which is selectively operable to control fuel supply to the fuel well 35 communicating with the secondary orifices 33.

More specifically, the selector valve 121 can be of various constructions, and in the illustrated construction, the selector valve 121 includes a valve chamber 123 which communicates through a suitable conduit 125 with an inlet 127 communicating with the duct means 61 supplying fuel to the fuel well 35. The valve chamber 123 also communicates through a suitable conduit 131 with the outlet or port 115 from the secondary fuel chamber or float bowl 83, and the primer fuel chamber 97. Still further, the valve chamber 123 communicates through a suitable conduit 135 with an auxiliary outlet or port 137 adjacent the bottom of the primary or first float bowl 41.

The selector valve 121 also includes a valve member 141 which is movable in the valve chamber 123 between a first position operable to communicate the outlet or port 115 from the secondary float bowl or fuel chamber 83 and the primer fuel chamber 97 with the inlet 127 communicating with the duct means 61 communicating with the fuel well 35 and disconnecting the auxiliary outlet or port 137 of the primary float bowl 41 from the inlet 127 leading to the fuel well 35, and a second position operable to communicate the auxiliary outlet or port 137 of the primary float bowl 41 with the inlet 127 communicating with the duct means 61 communicating with the fuel well 35 and disconnecting the outlet or port 115 from the secondary fuel chamber or float bowl 83 and the primer fuel chamber 97, from the inlet 127 communicating with the duct means 61 leading to the fuel well 35.

The valve member 141 is suitably connected to a handle 143 accessable by an operator for selective positioning of the valve member 141 between the first and second positions.

In operation, assuming the carburetor or primary float bowl 41 is in communication with a source of fuel, such as kerosene, and assuming the secondary fuel chamber or float bowl 83 is in communication with a source of fuel, such as gasolene, the selector valve 121 is initially located in the first position so as to communicate the secondary fuel chamber or float bowl 83 and the primer fuel chamber 97 with the fuel wall 35. As a consequence, depression of the plunger stem 101, against the action of the spring 103, will supply primer fuel (gasoline) to the fuel well 35 and through the secondary orifice 33 to the fuel/air induction passage 15 to facilitate engine starting. In addition, engine operation will induce gasoline flow from the secondary fuel chamber or float bowl 83 through the fuel well 35 and secondary orifice 33 and to the induction passage 15 to sustain engine operation at low speed.

After initiation of engine starting, if it is desired to operate the engine at a higher speed, opening of the throttle valve 19 will accommodate flow of kerosene from the primary fuel bowl 41 through the duct means 51 and passage from the main fuel jet 31 into the induction passage 15. Upon reaching the desired high speed, the selector valve member 141 can be moved to the second position to discontinue supply of gasoline to the secondary orifice 33 and to thereafter supply kerosene to the secondary orifice 33, thereby conserving gasoline.

In some situations, it may be desirable to omit the selector valve 121 and to provide for direct communication, as shown in dotted outline at 151, between the secondary orifice 33 and the outlet or port 115 from the primer fuel chamber 97 and the secondary fuel chamber or float bowl 83. Under such circumstances, some gasolene would be used at all speeds.

Means are also provided for facilitating use of gasoline as fuel at all speeds in the event that the supply of kerosene is exhausted. While various arrangements can be employed, in the illustrated construction, the inlet duct 45 leading from the carburetor valve means 43 includes a disconnect fitting 161 releasably connected to a supply conduit 163 communicating with the source 47 of the first fuel (kerosene). In addition, the inlet duct 87 leading from the valve means 85 of the combined primer and secondary fuel chamber or float bowl 75 includes a disconnect fitting 171 which is of a construction identical to that of the fitting 161 associated with the inlet duct 45 leading from the carburetor float bowl 41 and which is releasably connected to a supply conduit 173 communicating with the source 89 of the second fuel (gasoline). Thus, if the supply of kerosene is exhausted, the kerosene supply conduit 163 can be disconnected from the fitting 161 and the gasoline supply conduit 173 can be disconnected from the second fitting 171 and reconnected to the first fitting 161 so as to supply gasoline to the carburetor 13. With the selector valve 121 in the second position, gasoline will then be supplied to the fuel induction passage 15 through both the main fuel jet 31 and through the secondary orifice 33.

Various of the features of the invention are set forth in the following claims.

I claim:

1. A fuel feeding device comprising a housing including a float chamber including float controlled valve means communicable with a source of fuel and operable to control supply of the fuel to said float chamber, a second chamber, duct means extending between said second chamber and said float chamber for supplying fuel to said second chamber from said float chamber, a movable wall located in said second chamber and defining a primer fuel chamber which can be varied in volume and which communicates with said duct means, means adapted for manipulation by an operator and connected to said movable wall for displacing said movable wall to vary the volume of said primer fuel chamber so as to effect fuel flow to and from said primer fuel chamber, check valve means in said duct means permitting fuel flow from said float chamber to said primer fuel chamber and preventing return flow to said float chamber, and an outlet communicating with said duct means between said primer fuel chamber and said check valve means.

2. A fuel feeding device in accordance with claim 1 and further including manually operable valve means for closing said outlet.

3. A fuel device in accordance with claim 1 and further including means biasing said movable wall to increase the volume of said primer fuel chamber.

* * * * *